US007494374B2

(12) United States Patent
Hall et al.

(10) Patent No.: US 7,494,374 B2
(45) Date of Patent: Feb. 24, 2009

(54) PANEL MOUNT ELECTRICAL CONNECTOR

(75) Inventors: John Wesley Hall, Harrisburg, PA (US); James Michael Raudenbush, Halifax, PA (US); Douglas John Hardy, Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/670,003

(22) Filed: Feb. 1, 2007

(65) Prior Publication Data

US 2008/0188123 A1 Aug. 7, 2008

(51) Int. Cl.
*H01R 13/73* (2006.01)

(52) U.S. Cl. ..... 439/564; 439/97; 439/954

(58) Field of Classification Search ..... 439/564, 439/562, 565, 931, 97, 954, 831
See application file for complete search history.

(56) References Cited

U.S. PATENT DOCUMENTS 4,273,407 A * 6/1981 Snuffer et al. ..... 439/579
4,895,535 A * 1/1990 Emadi et al. ..... 439/681
5,417,587 A 5/1995 Katsuda et al.
5,722,837 A * 3/1998 Kurahashi ..... 439/63
5,921,801 A 7/1999 O'Sullivan et al.
6,280,208 B1 8/2001 Masuda et al.
6,422,900 B1 7/2002 Hogan
6,676,445 B2 1/2004 Hall et al.
6,733,324 B1 * 5/2004 Lecsek et al. ..... 439/485
6,824,403 B2 11/2004 Hall et al.
2004/0018772 A1 1/2004 Zhang et al.
2005/0255720 A1 11/2005 Geil et al.

FOREIGN PATENT DOCUMENTS

GB 1 601 769 11/1981

* cited by examiner

*Primary Examiner*—Neil Abrams
*Assistant Examiner*—Harshad C Patel

(57) ABSTRACT

A housing is provided for use in an electrical connector. The housing includes an electrically conductive body having a mating end and a conductor exiting end, the mating end configured for coupling a mating connector. An electrically conductive flange is disposed between the mating end and the conductor exiting end in electrical communication with the body. The flange extends through an opening formed in an electrically conductive member and is detachably securable to the electrically conductive member for maintaining electrical communication between the member and the body.

12 Claims, 5 Drawing Sheets

PANEL MOUNT ELECTRICAL CONNECTOR

FIELD OF THE INVENTION

The present invention relates generally to electrical connectors and, more particularly, to a panel mount electrical connector.

BACKGROUND OF THE INVENTION

Radio frequency (RF) coaxial cable connector assemblies have been used for numerous automotive applications, such as global positioning systems (GPS), car radios, mobile phones, air bag systems, and multimedia devices. Coaxial cables typically consist of an outer conductor, an inner conductor, a dielectric, and a jacket or outer insulation. The outer conductor and the inner conductor of the cable often electrically interface with a mating coaxial cable through jack and plug connectors. Such conventional coaxial cable connectors are known in the art, for example, in U.S. Pat. Nos. 6,676,445 and 6,824,403, which are assigned to the assignee of the present invention and are expressly incorporated by reference in their entirety herein.

In order to standardize various types of connectors and thereby avoid confusion, certain industry standards have been established. One of these standards is referred to as FAKRA. FAKRA is the Automotive Standards Committee in the German Institute for Standardisation, representing international standardization interests in the automotive field. The FAKRA standard provides a system, based on keying and color coding, for proper connector attachment. The keying and color identifying features of a FAKRA connector are typically on an outer housing made of plastic or non-conductive material. Like jack keys can only be connected to like plug keyways in FAKRA connector assemblies. Secure positioning and locking of connector housings is facilitated by way of a FAKRA defined catch on the jack housing and a cooperating latch on the plug housing. In some applications such as an automobile radio, the connector must be grounded to the chassis of the radio. However, since the outer housing is non-conductive, current connectors require a separate means to ground the connector chassis. Consequently, what is needed is an electrical connector with a housing that is configured to couple with another connector assembly, such as a FAKRA connector assembly, in which the housing is also usable to provide an electrical grounding path to a chassis or other panel.

SUMMARY OF THE INVENTION

The present invention relates to a housing provided for use in an electrical connector. The housing includes an electrically conductive body having a mating end and a conductor exiting end, the mating end configured for coupling a mating connector. An electrically conductive flange is disposed between the mating end and the conductor exiting end in electrical communication with the body. The flange extends through an opening formed in an electrically conductive member and is detachably securable to the electrically conductive member for maintaining electrical communication between the member and the body.

The present invention further relates to an electrical connector. The connector includes a housing including an axial passageway. An electrical connector includes a portion of the housing, a contact and a dielectric, the contact and the dielectric configured to be received within the axial passageway. The housing includes an electrically conductive body having a mating end and a conductor exiting end, the mating end configured for coupling a mating connector. An electrically conductive flange is disposed between the mating end and the conductor exiting end in electrical communication with the body. The flange extends through an opening formed in an electrically conductive member and detachably securable to the electrically conductive member for maintaining electrical communication between the member and the body.

An advantage of the present invention is that electrical connector housings can be used to provide electrical grounding for mating FAKRA connector assemblies.

A further advantage of the present invention is that the electrical connector housings can be used with RF electrical appliances.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
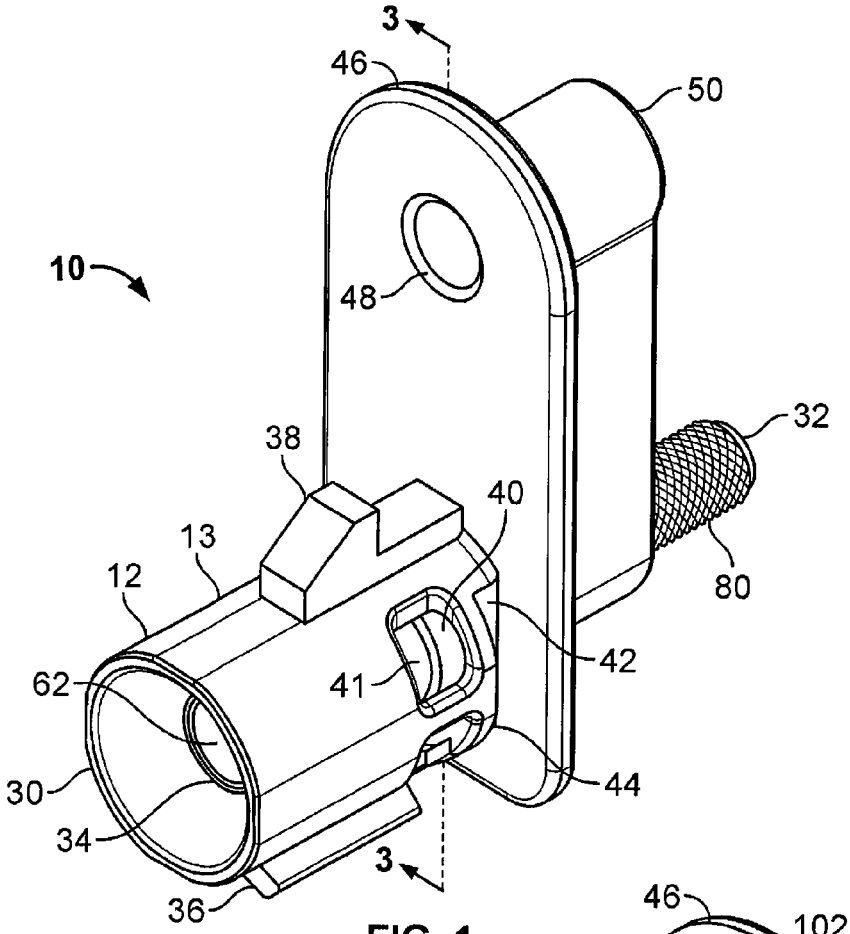
FIGS. 1 and 2 are opposed top perspective views of an embodiment of an electrical connector of the present invention.
Figure 2:
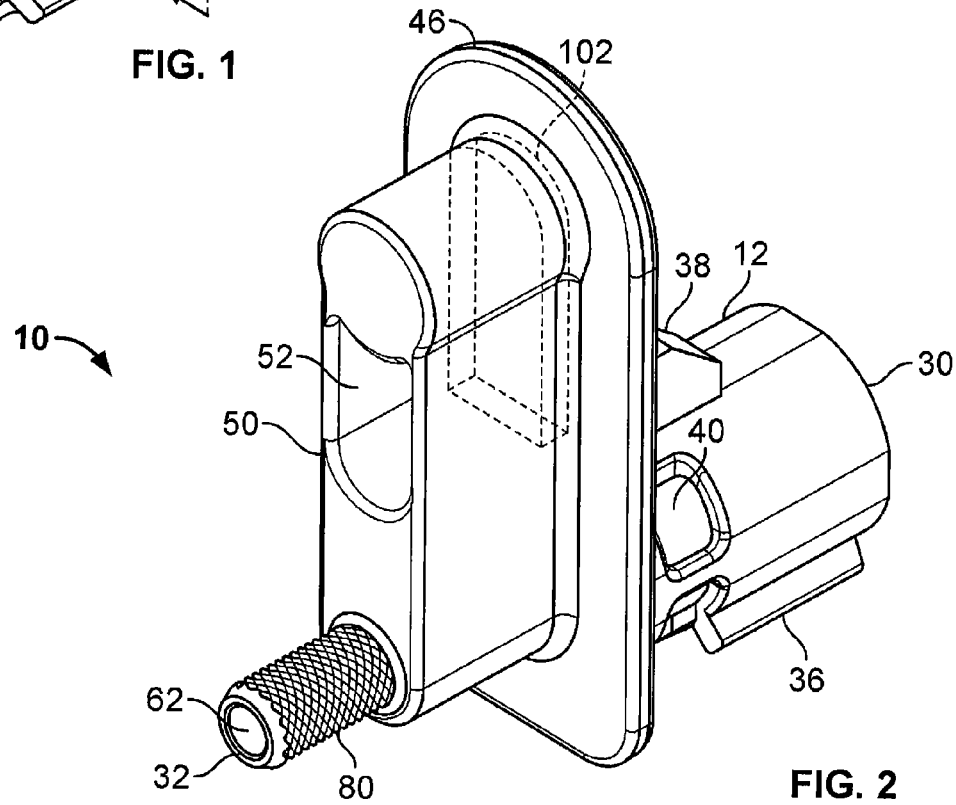
Figure 3:
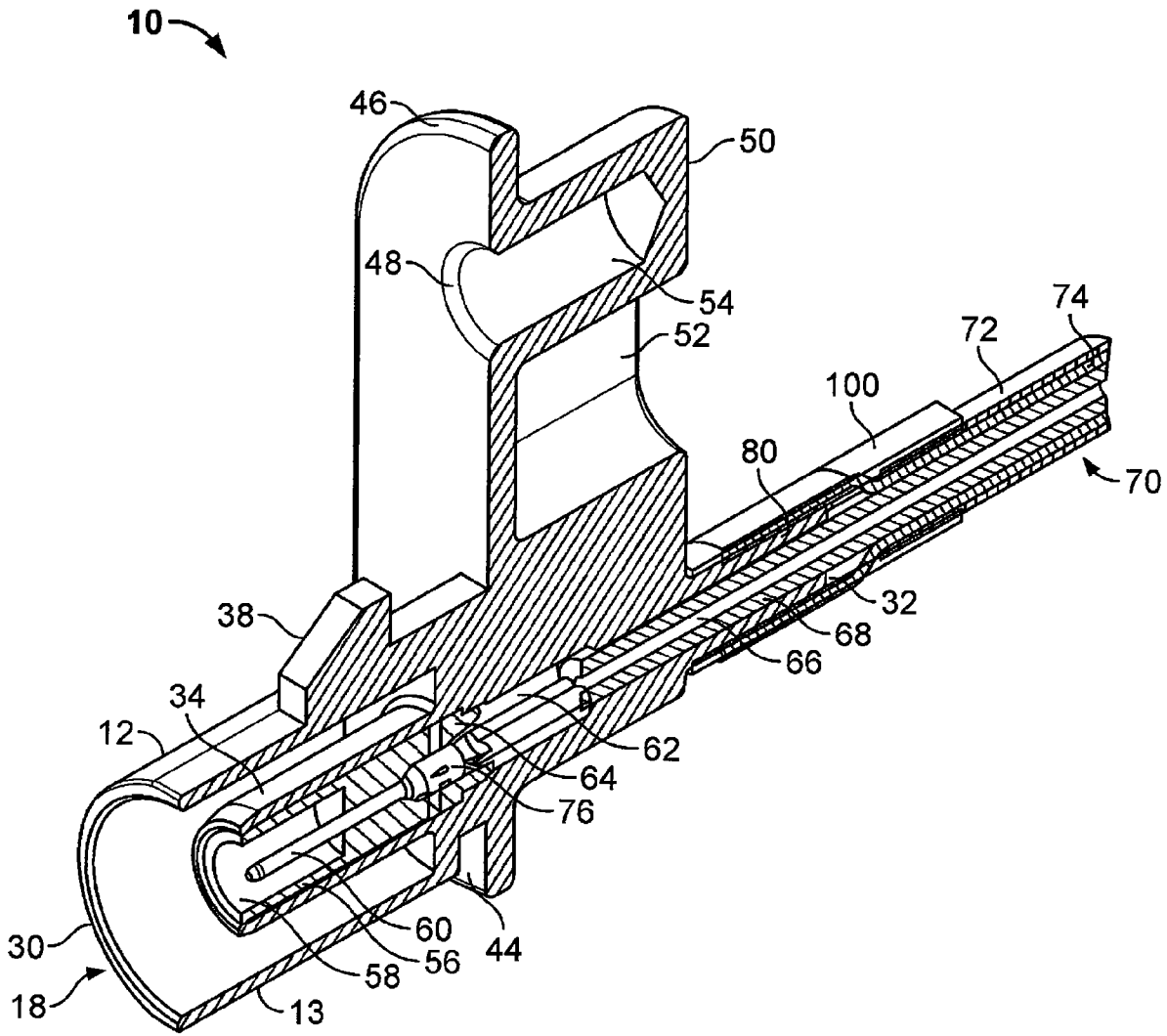
FIG. 3 is a cross section taken along line 3-3 of FIG. 1, further including a coaxial cable assembly.
Figure 4:
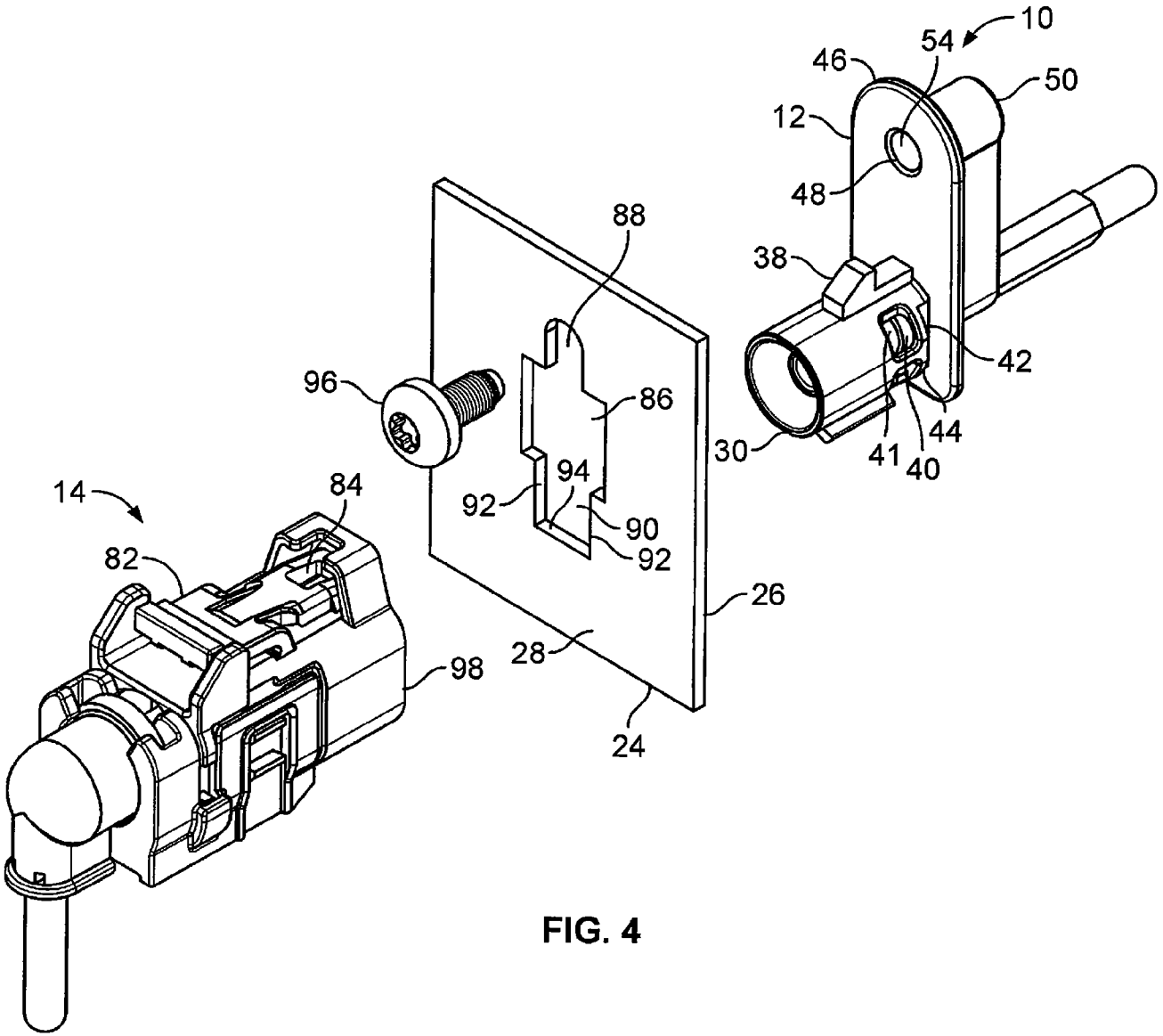
FIG. 4 is an exploded top perspective view of an application of a cable assembly using an embodiment of the connector of the present invention.
Figure 5:
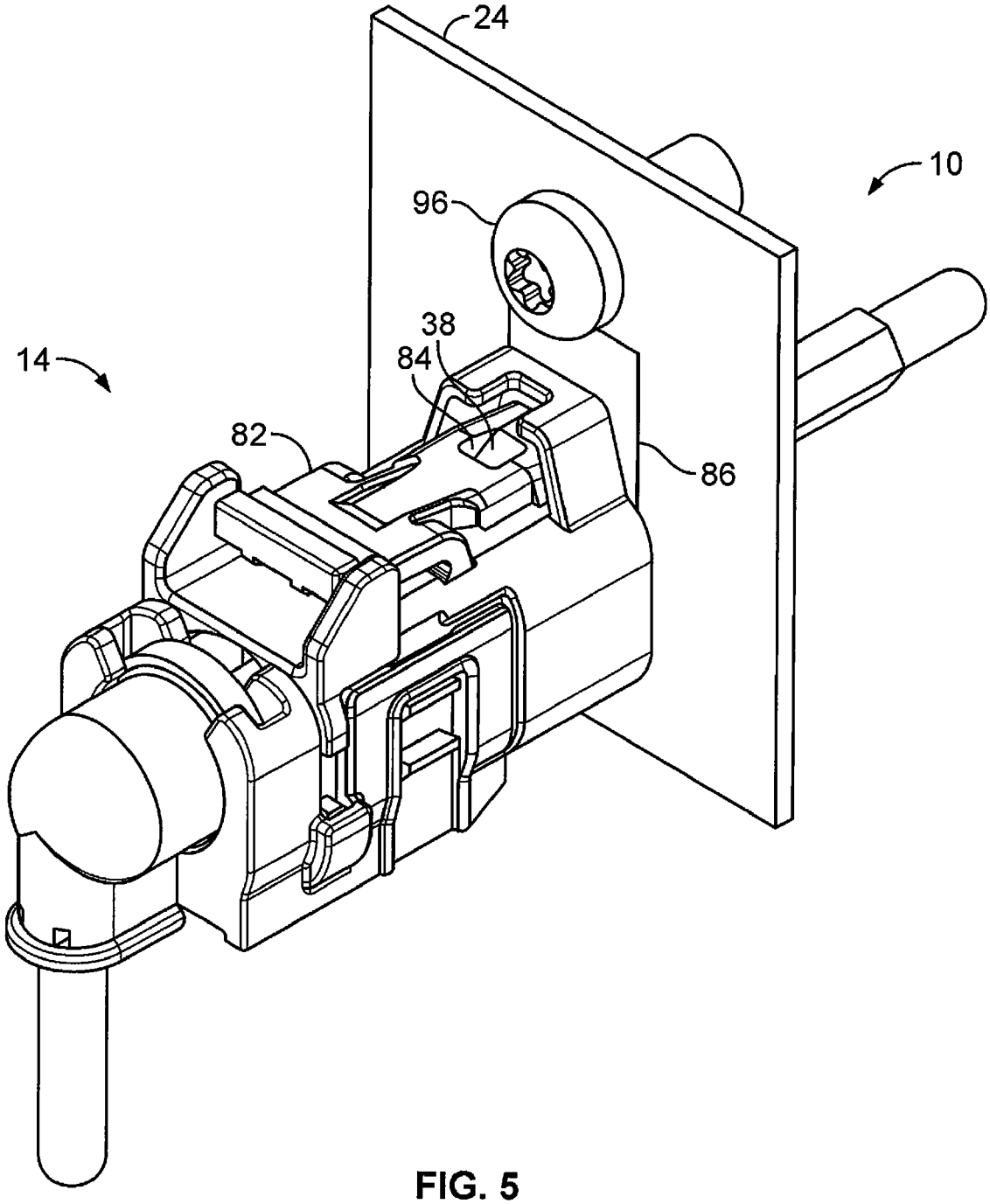
FIG. 5 is an assembled top perspective view of the application shown in FIG. 4.

Referring to FIGS. 1 and 2, an electrical connector 10 according to the present invention includes a body or housing 12 such as a jack connector that is configured to couple to a mating plug connector 14 (FIG. 4). Electrical connector 10 is configured for use as a panel mount connector (panel connector assembly), and as shown in FIGS. 4 and 5, is secured to an electrically conductive member 24, such as a panel or chassis, of an electrical appliance. It is to be understood that the term panel connector is intended to refer to an electrical connector that is configured to be secured to a member, such as a panel member of a structure or an electrical appliance, in which the connector protrudes through the panel member and mates with or couples another electrical connector. As shown in FIG. 3, jack connector 18 comprises connector 10 and coaxial cable assembly 70. As will be discussed in further detail below, body or housing 12 of electrical connector 10 permits use with radio frequency (RF) electrical appliances or other panel mount applications. As used herein, an RF electrical appliance is intended to include any electrical appliance that is capable of transmitting or receiving RF signals, or otherwise capable of operating with RF signals or an appliance that can be adversely affected by RF signals. However, body or housing 12 of electrical connector 10 permits shielding of signal contacts from unwanted outside noise voltages.

The present invention applies to the electrical ground path of the connector system. That is, the electrical circuit always has continuity to the electrical appliance ground. This electrical ground substantially eliminates stray electromagnetic interference.

In one embodiment, housing 12 is electrically conductive and is constructed of metal, such as a die cast metal. However, in another embodiment, housing 12 may be constructed of a material that is non-electrically conductive, but includes a conductive coating formed on the housing 12. The conductive coating can be applied by spraying, or immersion of housing 12 in a conductive solution, or by other suitable application methods. It is to be understood that housing 12 can also be constructed of combinations of non-electrically conductive materials and/or conductive coatings. In summary, housing 12 can be constructed of any suitable combination of conductive or non-conductive materials and conductive and/or non-conductive coatings, so long as housing 12 provides a ground path for grounding RF interference to the electrically conductive member 24 (FIG. 4). Stated another way, there must be an electrically conductive path between electrically conductive member 24 (FIG. 4) and connector 10, and also between connectors 10, 14, and/or between electrically conductive member 24 (FIG. 4) and each connector 10, 14.

Housing 12 includes an outer annular shell 13 having a mating end 30 for receiving a mating electrical connector and a conductor exiting end 32 to be discussed in further detail below. Disposed between ends 30, 32 is a flange 46 extending radially outward from outer annular shell 13. An annular alignment portion 34 is formed inside outer annular shell 13, with annular alignment portion 34 having a bore 62 formed longitudinally therethrough. Longitudinally extending radially outward from housing 12 between mating end 30 and flange 46 is a key 36 that inserts into a corresponding keyway (not shown) of connector 14 (FIG. 4) to provide keying between connectors 10, 14. In one embodiment, mating connector 14 is a FAKRA connector. Also extending radially outward from housing 12 between mating end 30 and flange 46 is a retainer 38 that engages an opening 84 (FIG. 4) formed in a latching mechanism 82 (FIG. 4) of mating connector 14 (FIG. 4) when connectors 10, 14 are brought together. This engagement maintains a secure connection between connectors 10, 14. An opening 40 is formed through outer annular shell 13, permitting use of tooling (not shown) to deform annular alignment portion 34 to retain dielectric 56.

Formed along the junction between outer annular shell 13 and flange 46 are opposed keyways 42, with a keyway 44 opposite retainer 38 bridging keyways 42. Flange 46 includes a backing portion 50 that extends longitudinally from flange 46 opposite retainer 38. In one embodiment, an aperture 48 is formed in flange 46, defining an open-ended hollow portion or chamber 54 (see FIG. 3). That is, hollow portion or chamber 54 is in communication with aperture 48, but chamber 54 does not fully extend through backing portion 50 (see FIG. 2). In one embodiment, an opening 52 is formed between chamber 54 and the portion of backing portion 50 that is longitudinally aligned with annular alignment portion 34. Opening 52 permits removal of a portion of material from backing portion 50 without substantially compromising the strength and structural rigidity of backing portion 50. Extending longitudinally from backing portion 50 away from retainer 38 is a sleeve 80 that terminates at a conductor exiting end 32.

With respect now to FIG. 3, the coaxial jack connector 18, which incorporates electrical connector 10, will be described in greater detail. Coaxial jack connector 18 includes a dielectric 56 having an annular portion 58 that is received by the annular alignment portion 34 of housing 12. Dielectric 56 secures a pin 60 that extends inside of annular portion 58 (see FIG. 3). Annular portion 58 includes a bore 62 that longitudinally extends through housing 12, i.e., adjacent mating end 30 to conductor exiting end 32. A base 76 of pin 60 receives and is in communication with an inner conductor 66 from a coaxial cable 70, which base 76 is received in an annular locking ring 64. Coaxial cable 70 extends through and past sleeve 80 that terminates at conductor exiting end 32.

It should be appreciated that the connector 10 as described above can be terminated to coaxial cable 70 where the coaxial cable 70 includes an outer insulation 72, an outer conductor or braid 74, inner conductor 66, and dielectric 68. As shown, conductor 66 is secured, e.g., crimped, to base 76 of pin 60 and the outer conductor or braid 74 is dressed over sleeve 80 and secured, e.g., crimped, by ferrule 100. However, it is to be understood that coaxial cable 70 is not limited to the arrangement shown and may include other coaxial conductor arrangements suitable for RF connector assemblies.

Referring to FIGS. 4 and 5, connector 10 is coupled to mating connector 14, which connector 14 is disclosed in application Ser. No. 11/257,334, which is assigned to the assignee of the present invention and expressly incorporated by reference in its entirety. Electrically conductive member 24 is a part of an electrical appliance, and in one embodiment, conductive member 24 is part of an enclosure for an electrical appliance. Conductive member 24 is used to establish an electrical ground path, either directly or indirectly, for both of connectors 10, 14, as will be discussed in additional detail below. In one embodiment, flange 46 of connector 10 is secured to a surface 26 that faces the interior of the electrical appliance. In other words, flange 46 is disposed interior of the electrical appliance. Mating end 30 of connector 10 is directed through opening 86 of conductive member 24 until flange 46 abuts surface 26. Once abutting contact is achieved, connector 10 is directed toward slot 90 so that opposed keyways 42 engage corresponding opposed slot edges 92 of slot 90. Connector 10 is further directed along slot 90 until keyway 44 abuts slot edge 94, thus initially securing connector 10 to conductive member 24.

Once connector 10 is initially secured, fastener 96, such as a self-tapping screw as shown in FIG. 4, is directed through an arcuate slot 88 and inside aperture 48, and then into hollow portion or chamber 54. Fastener 96 is then actuated in one direction to draw fastener 96 inside chamber 54 until the head of fastener 96 is brought into abutting contact with surface 28 of conductive member 24 that faces exterior of the electrical appliance, thus securing connector 10 in abutting contact with conductive member 24. However, other fastening devices or methods as known in the art can be used to secure connector 10 to conductive member 24. By virtue of hollow portion or chamber 54 becoming a substantially closed space once fastener 96 is inserted into the chamber 54, debris associated with securing flange 46 to conductive member 24, for example, shavings of backing portion 50, is substantially prevented from reaching the interior of the electrical appliance. Stated another way, debris, such as shavings of backing portion 50 removed by fastener 96 while fastener 96 is actuated, are substantially confined inside of chamber 54, substantially preventing the debris from reaching the interior of the electrical appliance.

To complete the installation or assembly between connectors 10 and 14, mating end 98 of mating connector 14 is brought into mating engagement with mating end 30 of connector 10. As shown in FIG. 5, connectors 10 and 14 are secured together once retainer 38 is received in opening 84 of latching mechanism 82. Referring to back to FIG. 4, it is appreciated by those skilled in the art that due to housing 12 and conductive member 24 being electrically conductive, as discussed above, there is at least one electrically conductive path established between electrically conductive member 24 and connector 10 sufficient to electrically ground connector 10 with conductive member 24. In other words, an electrically conductive path may be established between conductive member 24 and housing 12 by virtue of abutting contact between any of surfaces of conductive member 24, for example, surfaces 26, 28 and/or any edge along the periphery of opening 86, and any surface of housing 12, for example, flange 46 and/or keyways 42, 44. It is to be understood that flange 46 can be configured to abut either of surfaces 26 or 28.

Figure 6:
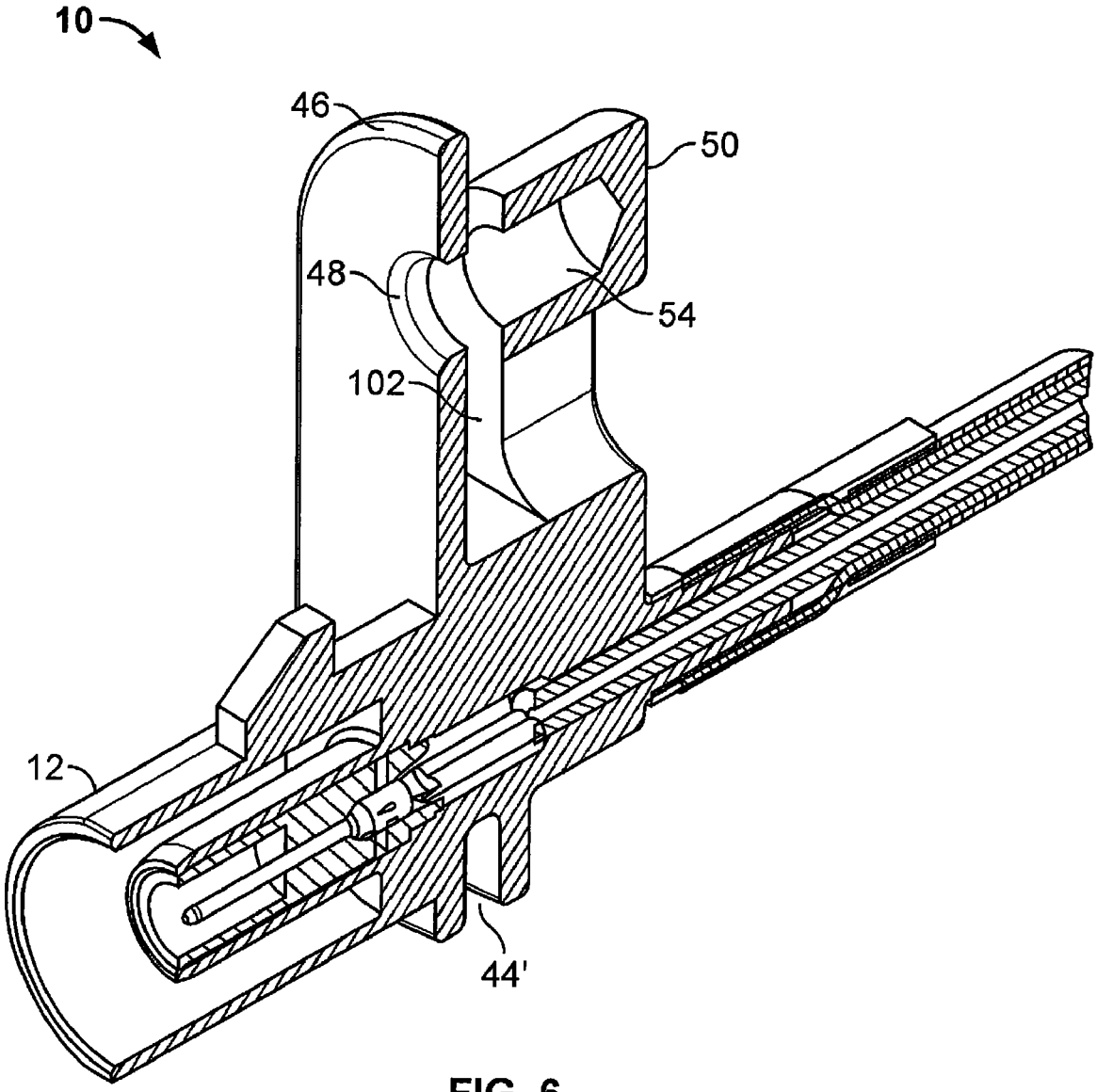
FIG. 6 is a cross section of an alternative embodiment of the connector of the present invention.

For example, referring to FIG. 6, which is taken along line 3-3 of FIG. 1, one embodiment of housing 12 further includes a slot 102 as shown in FIG. 2 formed in housing 12. That is, slot 102 permits conductive member 24 (FIG. 4) to be received along the juncture between flange 46 and backing portion 50. Stated another way, housing 12 receives conductive member 24. In addition, keyway 44', otherwise similar to keyway 44 (FIG. 1), is aligned with slot 102, but otherwise, the embodiment of housing 12 in FIG. 6 is substantially similar to the embodiment of housing 12 in FIG. 3. It is appreciated that in this embodiment, flange 46 abuts surface 28 (FIG. 4), i.e., flange 46 is disposed exterior of the electrical appliance with backing portion 50 inserted through opening 86 (FIG. 4) of conductive member 24. In addition, by virtue of the opposed surfaces 26, 28 of conductive member 24 being configured to substantially abut corresponding portions of flange 46 and backing portion 50, debris associated with securing flange 46 to conductive member 24, for example, shavings of backing portion 50 or conductive member 24, is substantially prevented from reaching the interior of the electrical appliance with backing portion 50 inserted through opening 86 (FIG. 4) of conductive member 24. Stated another way, debris, such as shavings of backing portion 50 and/or conductive member 24 removed by fastener 96 while fastener 96 is actuated, are substantially confined inside of chamber 54, substantially preventing the debris from reaching the interior of the electrical appliance.

Similarly, at least one electrically conductive path is established between connector 10 and electrically conductive member 24, and possibly an additional electrically conductive path is established between connector 14 and connector 10. That is, in one embodiment, it is possible that housing 12 of connector 10 does not establish a sufficient electrically conductive path with connector 14, so long as connector 10 is configured to ensure that a sufficient electrically conductive path is provided between connector 14 and conductive member 24 which is sufficient to electrically ground connector 14 with conductive member 24. In other words, an electrically conductive path must exist between connector 10 and conductive member 24 for there to exist an electrically conductive path between connectors 10 and 14.

In summary, referring back to FIG. 4, housing 12 can be constructed of any suitable combination of conductive materials and conductive and/or non-conductive coatings, so long as RF interference associated with either or both connectors 10, 14 is grounded to the electrically conductive member 24. Stated another way, there must be an electrically conductive path or electrical communication between electrically conductive member 24 and connector 10, and/or in one embodiment, between electrically conductive member 24 and connectors 10, 14, as previously discussed.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electrical connector comprising:

an electrically conductive body comprising:

an exterior surface;

a flange projecting outward from the body; and a backing portion projecting outward from the body;

the flange comprising a first major surface and a second major surface, the flange further comprising an aperture formed through the first major surface and the second major surface, the aperture being configured to receive at least part of a fastener therethrough;

the backing portion having a third major surface, the third major surface facing the second major surface of the flange, the backing portion comprising a cavity formed through the third major surface, the cavity opening being substantially aligned with the aperture, the cavity being configured to receive therein an end of a fastener;

a slot defined by a gap between the second major surface of the flange and the third major surface of the backing portion; and a keyway formed in the body, the keyway being aligned with the gap.

2. The electrical connector of claim 1, wherein the axis of the aperture is parallel to a major axis of the connector housing.

3. The electrical connector of claim 1, wherein the cavity is configured to receive and store shavings and other debris associated with screwing or otherwise inserting a fastener through the aperture and the cavity opening.

4. The electrical connector of claim 1, wherein the composition of the exterior surface of the electrically conductive body comprises a conductive coating.

5. An electrical connector system comprising:

a ground comprising a substantially planar conductive member comprising a planar opening, a first interior edge, and a second interior edge, the perimeter of the planar opening being defined at least in part by the first interior edge and the second interior edge, the first interior edge bordering a first area of the planar opening, the first area being configured to receive at least part of a fastener therethrough, the second interior edge bordering a second area of the planar opening, the second area being configured to receive a mating end of a connector housing therethrough;

a connector housing comprising a mating end and an electrically conductive body, the electrically conductive body comprising:

an exterior surface;

a flange projecting outward from the body; and a backing portion projecting outward from the body;

the flange comprising a first major surface and a second major surface, the flange further comprising an aperture formed through the first major surface and the second major surface, the aperture being configured to receive at least part of a fastener therethrough;

the backing portion having a third major surface, the third major surface facing the second major surface of the flange, the backing portion comprising a cavity formed through the third major surface, the cavity opening being substantially aligned with the aperture, the cavity being configured to receive therein an end of a fastener;

a slot defined by a gap between the second major surface of the flange and the third major surface of the backing portion, the slot and the substantially planar conductive member being mutually configured wherein, upon insertion of the first interior edge of the substantially planar conductive member into the slot, the first area of the planar opening is substantially aligned between the aperture and the cavity opening; and a keyway formed in the body, the keyway being aligned with the gap, the keyway and the substantially planar conductive member being mutually configured wherein the second interior edge of the substantially planar conductive member can engage the keyway, thereby assisting in securing the substantially planar conductive member to the electrically conductive body.

6. The system of claim 5, wherein the axis of the aperture is parallel to a major axis of the connector housing.

7. The system of claim 5, wherein the second interior edge opposes the first interior edge.

8. The system of claim 5, wherein the cavity is configured to receive and store shavings and other debris associated with screwing or otherwise inserting a fastener through the aperture and the planar opening.

9. The system of claim 5, wherein the composition of the exterior surface of the electrically conductive body comprises a conductive coating.

10. The system of claim 5, wherein the substantially planar conductive member is a part of an electrical appliance.

11. The system of claim 5, wherein the substantially planar conductive member is a part of an enclosure for an electrical appliance.

12. The system of claim 5, wherein the mating end is configured for coupling a FAKRA connector assembly.

* * * * *